US006120215A

United States Patent [19]

Ozaki

[11] Patent Number: 6,120,215

[45] Date of Patent: Sep. 19, 2000

[54] BREAST WALL CONSTRUCTION

[75] Inventor: Tetsuya Ozaki, Yamaguchi, Japan

[73] Assignee: Sanyo Mapps Co. Ltd., Yamaguchi, Japan

[21] Appl. No.: 09/377,933

[22] Filed: Aug. 20, 1999

[30] Foreign Application Priority Data

Aug. 25, 1998 [JP] Japan ..... 10-255977

[51] Int. Cl.[7] ..... E02D 29/00

[52] U.S. Cl. ..... 405/284; 52/581; 405/258; 405/273

[58] Field of Search ..... 405/262, 284, 405/286, 285, 258; 52/239, 582.1

[56] References Cited

U.S. PATENT DOCUMENTS

| | | | |
|---|---|---|---|
| 554,680 | 2/1896 | Haentges | 405/273 X |
| 1,909,299 | 5/1933 | Mette | 405/284 |
| 3,269,125 | 8/1966 | Moore | 52/581 X |
| 4,661,023 | 4/1987 | Hilfiker | 405/262 |
| 5,030,035 | 7/1991 | Babcock | 405/262 |
| 5,174,688 | 12/1992 | Meheen | 405/262 X |

*Primary Examiner*—Dennis L. Taylor
*Attorney, Agent, or Firm*—Coats & Bennett, P.L.L.C.

[57] ABSTRACT

A breast wall construction which can be constructed easily, quickly and safely at any execution sites includes many breast wall panels arranged in rows. On the back of the breast wall panel rows, many joint brackets with truss construction are placed with the front vertical area of the joint brackets joined to the back of the breast wall panel row which forms the bottom step and the back of the upper horizontal area of the joint brackets joined to the bottom of the top step breast wall panel row which is formed one step higher than the breast wall panel row which forms the bottom step.

16 Claims, 9 Drawing Sheets

BREAST WALL CONSTRUCTION

FIELD OF THE INVENTION

This invention relates to breast wall constructions suitable for use as soil guards for a sand bank, shore protection, side-slope protection, hillside soil guard, landslide reconstruction, pier protection, foot protection, and the like by filling with stones.

BACKGROUND OF THE INVENTION

For prior art shore protection works, the front of the slope stopper is covered with ripraps and concrete blocks to prevent erosion of the end of the slope and foundation movement by waves. Also, foot protection of the end of the slope is performed to prevent the progress of foundation movement or erosion. For foot protection, many methods of construction are used there is the soil guard execution method as one example shown in Japanese patent application 04359388 to Matsuoka. The Matsuoka sand guard is constructed by a cage frame formed on site using bar steel wire frame, expanding wire netting, horizontal joint material, diagonal bracing and end part wire netting as main parts, and this cage frame is filled with earth and sand and stacked up like steps.

However, the Matsuoka method has several disadvantages. First, because the earth- and soil-filled cage frames are heavy, the process of stacking up these cage frames like steps requires heavy machinery, like a big crane, making the process difficult in small work sites. Also, moving the heavy earth and soil blocks is a very dangerous operation. Second, because the cage frame is substantially made by wire netting, it does not have good strength. When earth and soil filled, the wire netting may not be able to handle the weight of earth and soil and will deform. Further, when it is used as shore protection, the wire netting cages may be deformed by a big force of water, like floodwaters. In such situations, the functionality is lost because the earth and soil will flow out.

As such, there remains a need for an improved breast wall construction which can be constructed easily, quickly and safely at many sites.

SUMMARY OF THE INVENTION

A breast wall construction is formed by connecting a series of rectangular breast wall panels into rows and thereby forming a surface terrace. The areas between the breast wall panels and the natural slope are filled by with stones, broken stones, gravel and the like.

To construct the breast wall, the first step breast wall panel row is formed by horizontally joining many breast wall panels together. Many joint brackets connect the back of this breast wall panel row to the back of the panels forming the next higher level, thereby joining the first step to the second step. By joining similarly the breast wall panel rows from the second step to the next step, and so forth, the surface terrace-like steps are formed. Thereafter, the stone filling space formed between the soil slope and the surface terrace is filled with stones, the breast wall is constructed.

Because the breast wall construction is constructed by substantially joining the breast wall panels horizontally, backward and forward using the joint brackets, the breast wall can be constructed easily, quickly and safely without using heavy machinery. Especially, by using the breast wall panels which are 40–80 cm (height)×100–150 cm (length), weighing 10–30 kg and made of cast iron, the breast wall panels can be handled more easily.

In some embodiments, a second set of joint brackets, ("second joint brackets") may be used at some or all of the joints. Preferably, the second joint brackets are of the same overall shape as the main joint brackets, and more preferably are identical thereto. The second joint brackets may be used to connect the front of lower level breast wall panels to the front of the next higher level breast wall panel. By joining the top and bottom steps of the breast wall panels together using two joint brackets, the joint strength of the breast wall panel rows can be very much improved.

By putting the breast wall support stay between the first joint brackets and the soil slope, the surface terrace constructed by many steps of breast wall panel rows can be easily and safely formed, and even the high breast wall can be constructed easily, quickly and safely.

Further, by forming the joints on the both sides of each breast wall panel as one and fitting the joints which are placed on the front vertical area of the first joint brackets as one to the corresponding joints of the adjacent breast wall panel, joining the breast wall panels together and the breast wall panel rows together can be performed at the same time. By using such an approach, the breast wall can be constructed easily and quickly.

The joints formed on the breast wall panels joint have a central extending area (central tine) which has a symmetrical pointed end. Disposed on each side of the central tine are outer tines that have tilted contacting faces on the outside of their pointed ends. The base areas of the tines meet at a common location. A pair of step forming panels (embossments) set on respective sides of the central tine help form respective hook-shaped spaces between the central tines and the corresponding outer tine.

The breast wall panel can be made of cast iron with many openings. By forming the breast wall panel with cast iron, the strength of the breast wall construction can be very much improved. When it is filled with stones, or when it is pressured by the soil from the back, the deforming of the surface terrace can be prevented, and the collapse of the breast wall can be effectively prevented. Because the breast wall panel is made of cast iron, when the breast wall is under the water, the part of microscopic elements of iron, silicon, manganese, phosphorus, sulfur, magnesium, and the like leach out to promote bacteria to attach and alga to propagate, and with that, the most appropriate environment for habitat of many types of organism including plants and fish (collectively "biotope") can be easily created. Because the breast wall panel is made of cast iron, with a high quantity of carbon, the corrosion protective covering is created by reaction between carbon and other contained metal constituents, and it is resistant to seasons. It has enough corrosion resistance on the ground and even under the water, and is actually proven to be able to be used for a long time.

Because the breast wall panel is made of cast iron, the same shape type of breast wall panel can be mass-produced by one cast type, and the unit price of breast wall panel can be decreased. Furthermore, for cast iron, it is better to use the cast iron which is produced in a cupola which contains, besides iron and carbon, calcareous, magnesium and so on. And from the viewpoint of improving the mechanical strength of breast wall panel, it is better to use ductile cast iron (FCD), moreover, austenite tempered ductile cast iron (ADI).

The breast wall panels placed on the up and down steps are joined by forming the joints on the breast wall panels as one, forming the joint parts on the first joint brackets and the second joint brackets as one, and fitting the joint parts to the joints. Moreover, the breast wall panel and the first and second joint brackets can be made of cast irons.

As the above, by forming the breast wall panel and the first and second joint brackets by cast irons, the type of material is the same, so there is less galvanic corrosion, the durability of the breast wall construction is improved, and it is easy and certain to join the breast wall panels together and the first and second joint brackets together.

The joint parts can be the wedge-shaped parts. By using the wedge-shaped parts, the joints of the breast wall panels can be joined tightly by the joint parts. Therefore, the joint strength of the breast wall panels can be more improved.

DETAILED DESCRIPTION OF THE INVENTION

Figure 1:
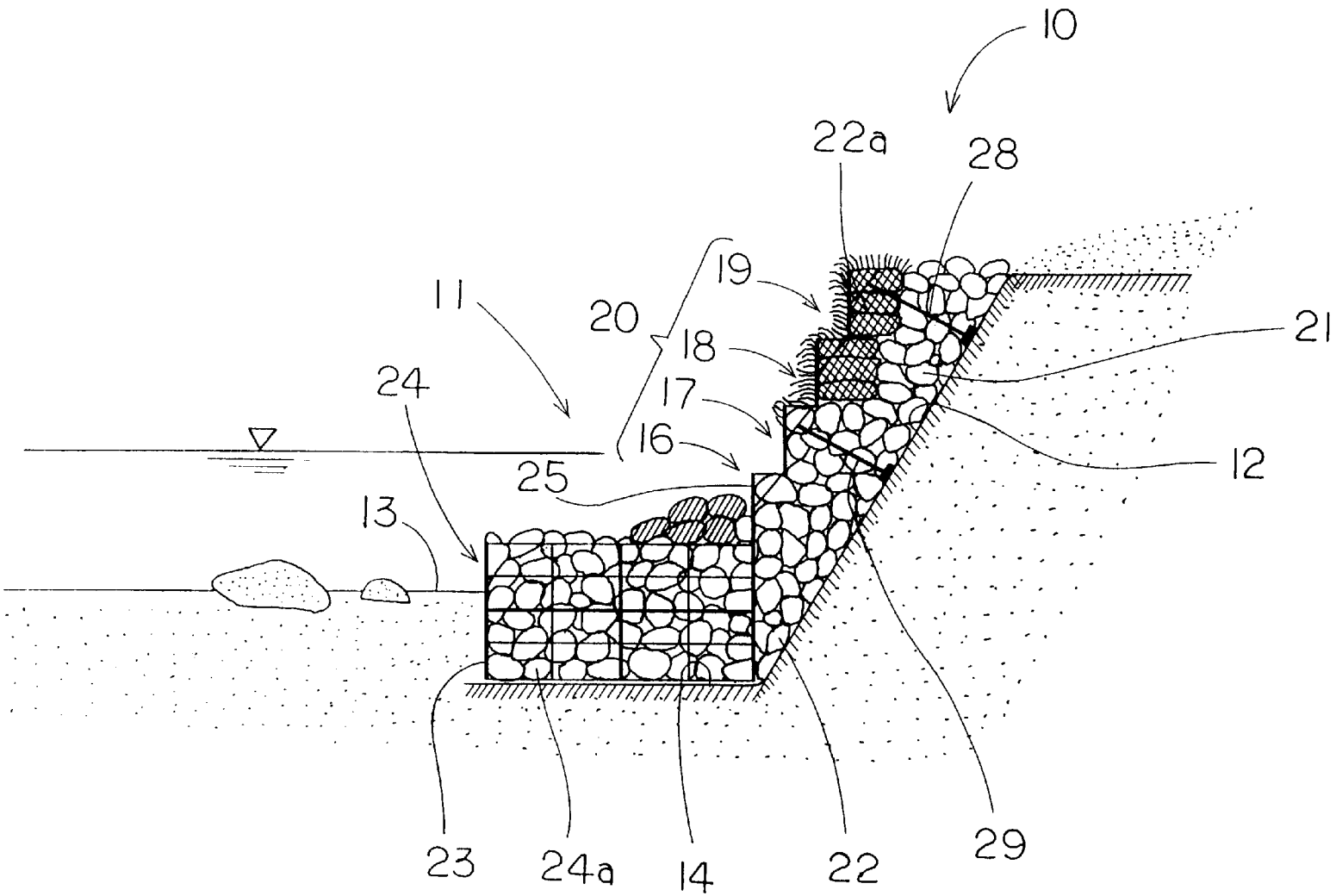
FIG. 1 shows a side cross section of the breast wall construction of the present invention.

Referring to the Figures, an example of the breast wall construction is explained. The illustrated example is for a breast wall construction used as a shore protection wall 11 constructed on the riverbank 10. As FIG. 1 shows, the riverbank 10 is formed by the soil slope 12 which has the fixed gradient (for example, the ratio of the horizontal length unit to the height is 1:0.5–1:1.5.) and the bottom of excavation 14 connected to the soil slope 12 which are placed by excavating the bottom of the river 13.

Figure 2:
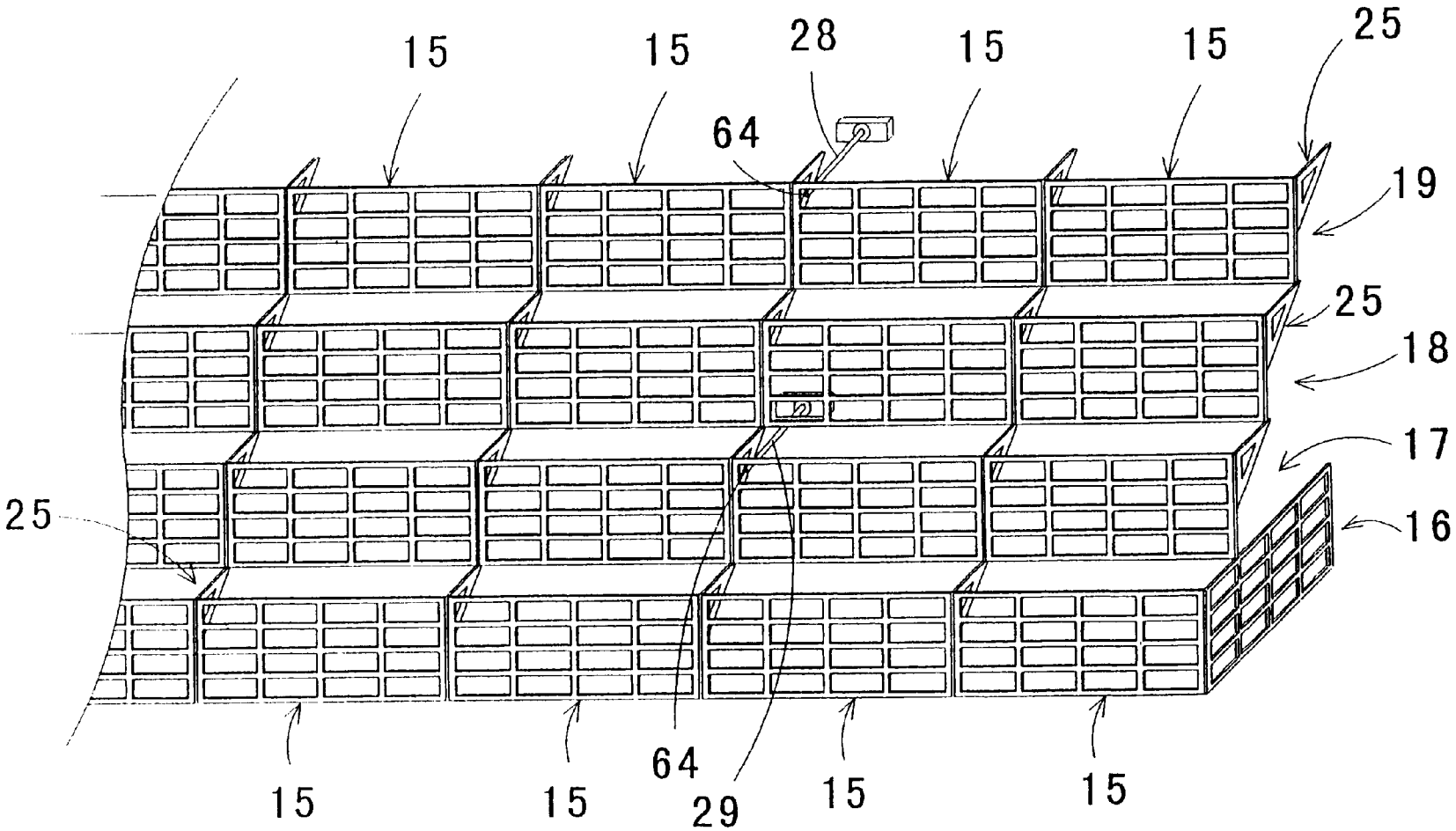
FIG. 2 shows a perspective view of the breast wall of FIG. 1.

As FIGS. 1 and 2 show, the shore protection wall 11 is substantially formed by forming the surface terrace 20 by placing many breast wall panel rows 16–19 like steps along with the soil slope 12 which are constructed by joining each of many rectangle breast wall panels 15 horizontally, and by filling stones 22 into the stone filling spaces 21 which are formed between the soil slope 12 and the surface terrace 20. On the bottom of excavation 14 many cage frames 24 are placed, such as those disclosed in the Applicant's co-pending application entitled "Cage Frame for Shore Protection" which is incorporated herein by reference. The panels 23 of the cage frame 24 are preferably formed by using the breast wall panel 23 which has the same construction as the breast wall panel 15. The inside areas of the cage frames 24 are filled with stones 24*a*. These cage frames for shore protection 24 form the part of the shore protection wall 11. Further, as FIG. 1 shows, many plant sand bags 22*a* which are seeded with the desirable plants seeds may be placed in front of the stones 22 which fill the top part of the filling space 21.

Figure 5:
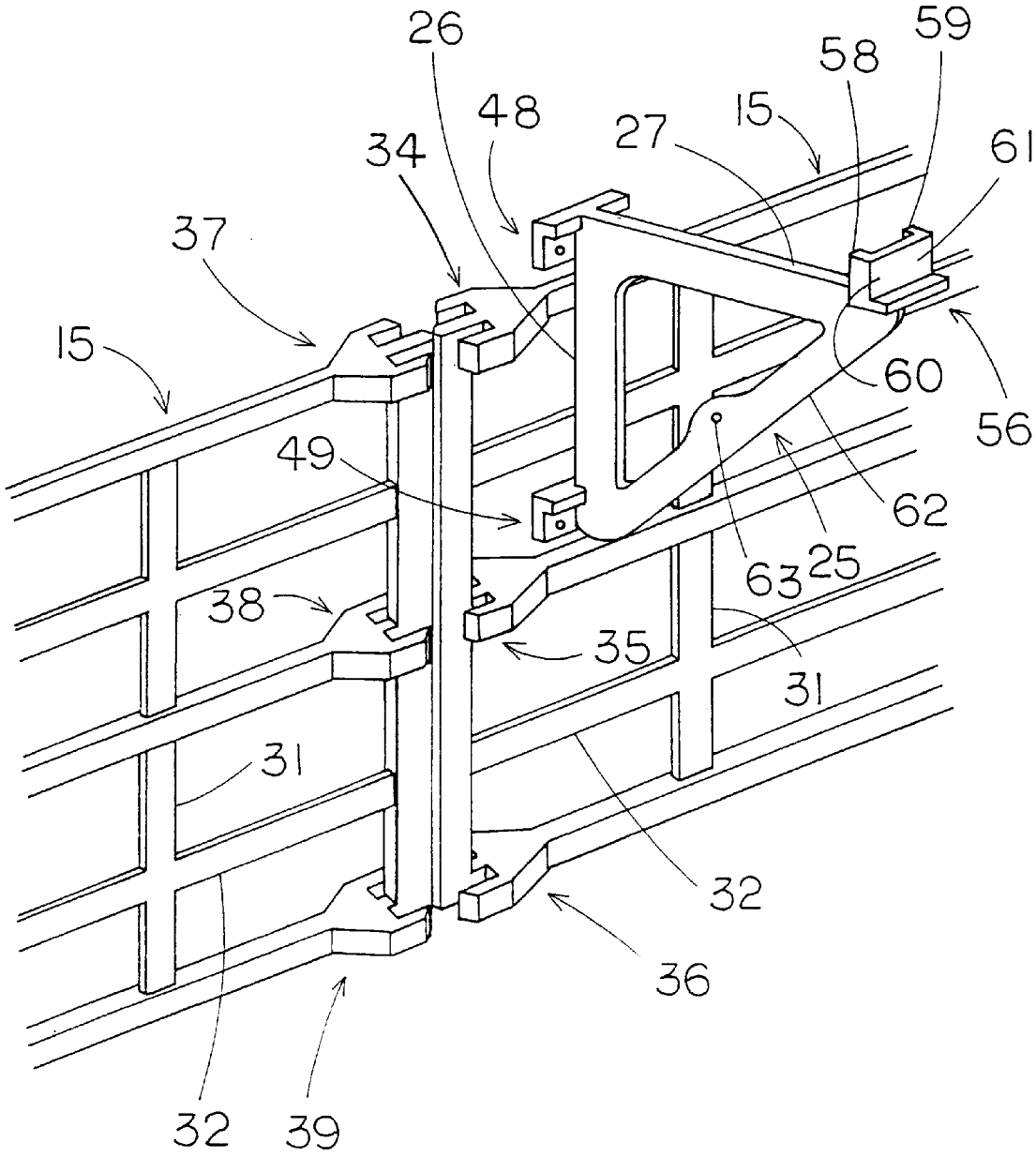
FIG. 5 shows a perspective, partially exploded view of a joint between breast wall panels of the row and the first type joint bracket.

Many first joint brackets 25, with truss construction expanding at right angle to the breast wall panel rows 16–19, are placed at spaced horizontal positions at the rear of the breast wall panel rows 16–19 (See FIGS. 1, 2 and 5). The front vertical area 26 of first joint brackets 25 are joined to the back of the breast wall panel rows 16–19. The back of the upper horizontal area 27 of the first joint brackets 25 are joined to the bottom of the next higher breast wall panel row 17–19. Further, many breast wall support stays 28 and 29 are placed between the first joint brackets 25 and the soil slope 12.

Figure 3:
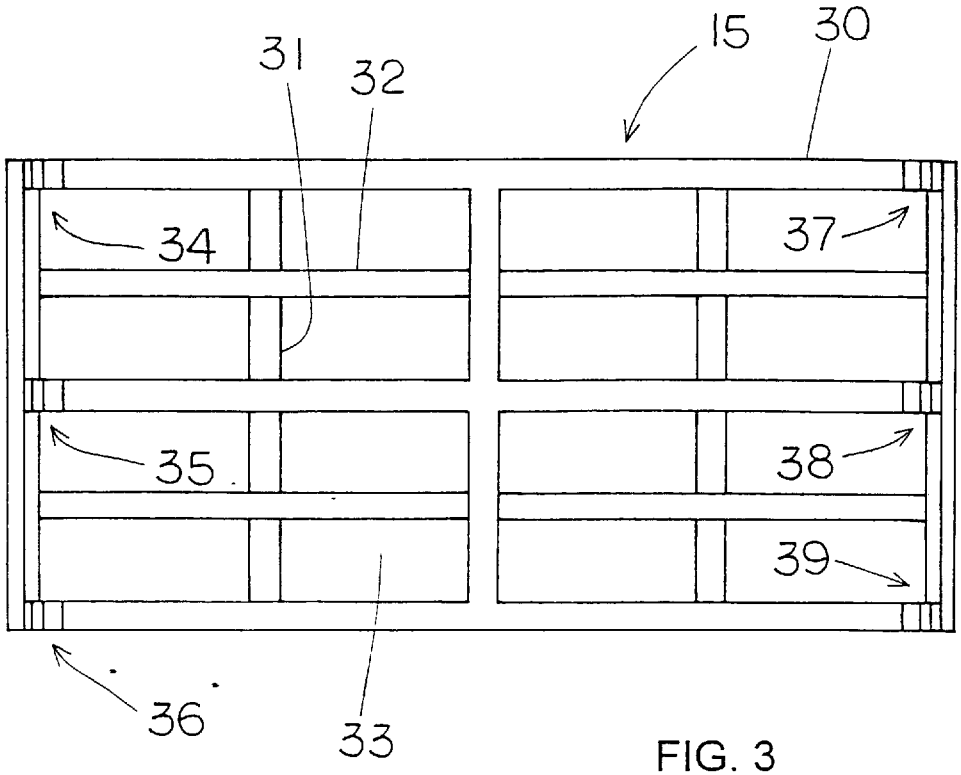
FIG. 3 shows a front view of a breast wall pane suitable for the present invention.

Referring to FIG. 3, the breast wall panel 15 is constructed by building many vertical and horizontal cross pieces 31 and 32 on a main rectangle framing 30. Openings 33 are formed between the vertical and horizontal cross pieces 31 and 32. Shaped joints 34–39 are located at the top, middle and bottom part of both sides of the breast wall panel 15. The shaped joints 34–39 are integrally formed with the breast wall panel 15.

Figure 4:
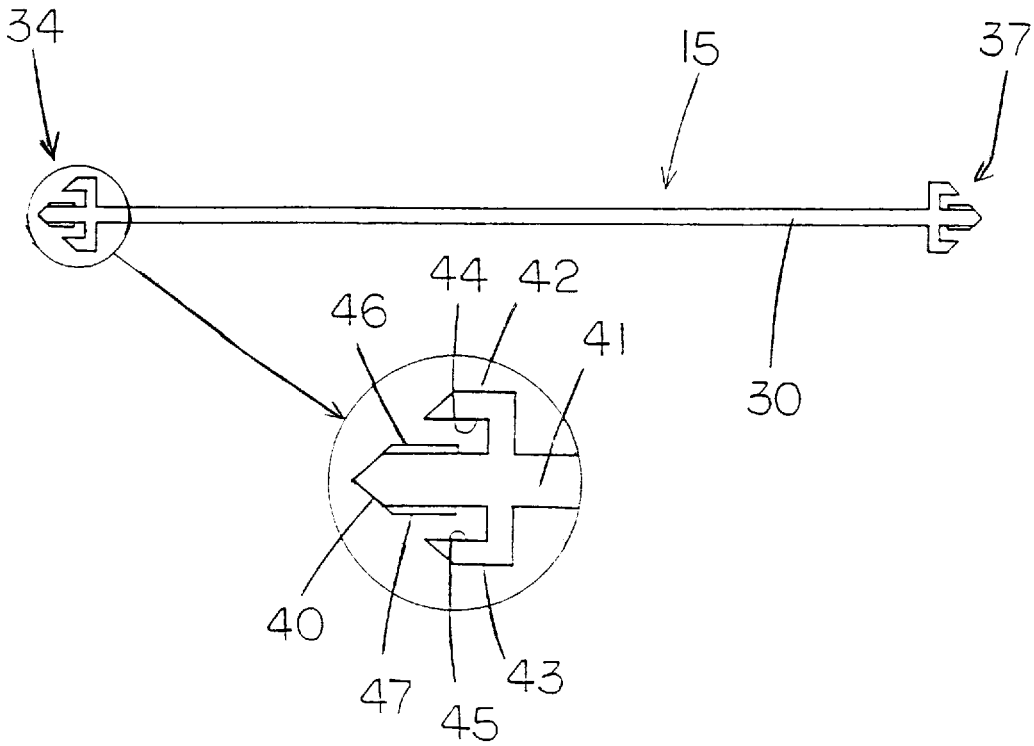
FIG. 4 shows a top view of the breast wall pane of FIG. 3.

As FIG. 3–5 show, each joint 34–39 has a central extending area 41 (or, "central tine") which is parted in the middle and, for example, has the pointy contacting face 40 with a 45° angle. Right and left expanding parts 42,43 (or, "outer tines") are set on both sides of the central extending area 41 likewise have a 45° angle contacting face on the outside of their points. The base areas of the central extending area 41 and the right and left expanding parts 42,43 attach to the breast wall panel 15 in a common location. The central extending area 41 has a pair of step form panels 46,47 (embossments) which help form the hook-shaped wedged parts inserting space 44,45, as an example of the joint part inserting space by working with right and left expanding parts 42,43. Preferably, the breast wall panel 15, which has the above joints 34–39 intergrally formed therein, is made of cast iron and produced using a cupola or the like.

Figure 6:
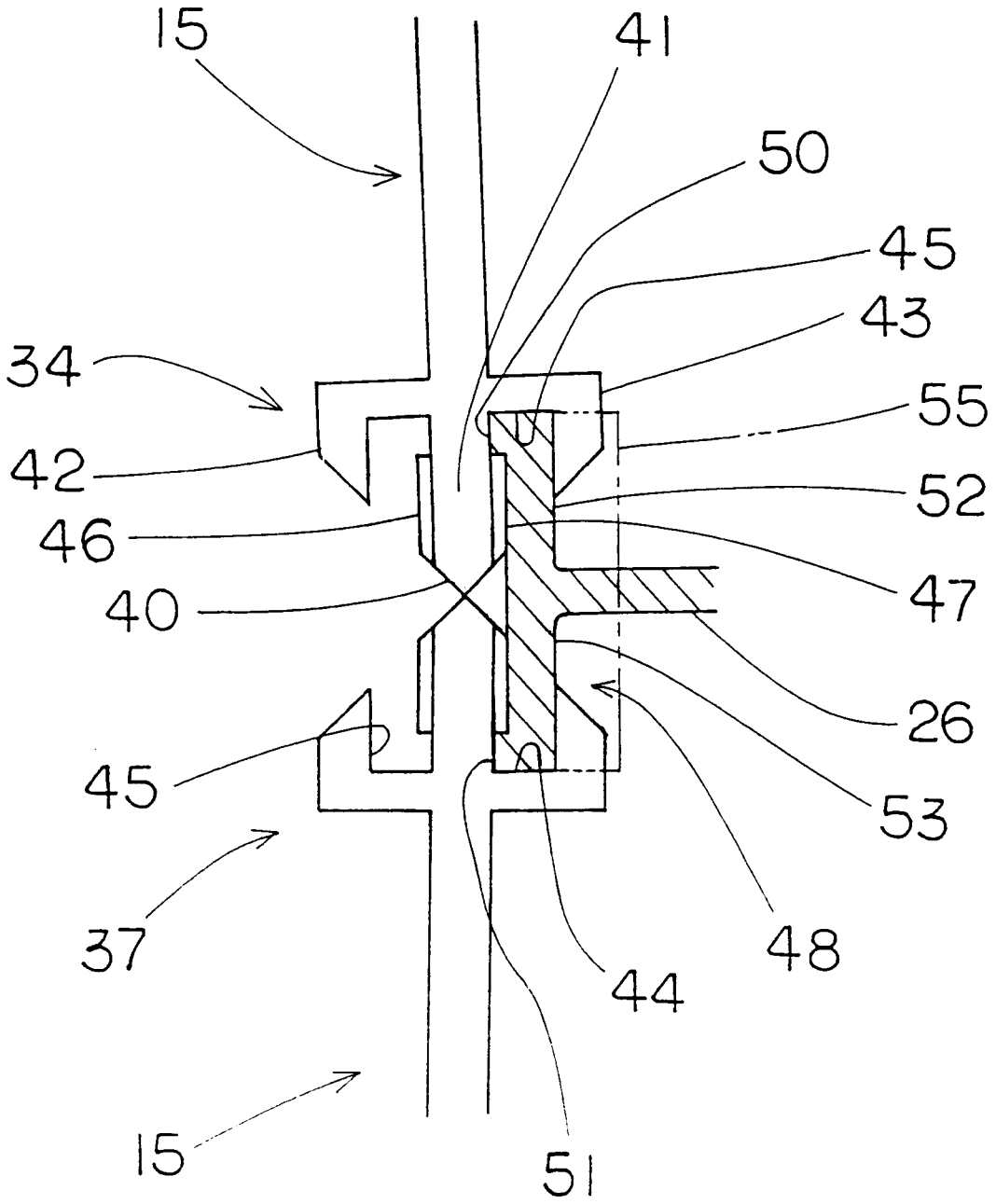
FIG. 6 shows a top view of a partially assembled joint of FIG. 5.
Figure 7:
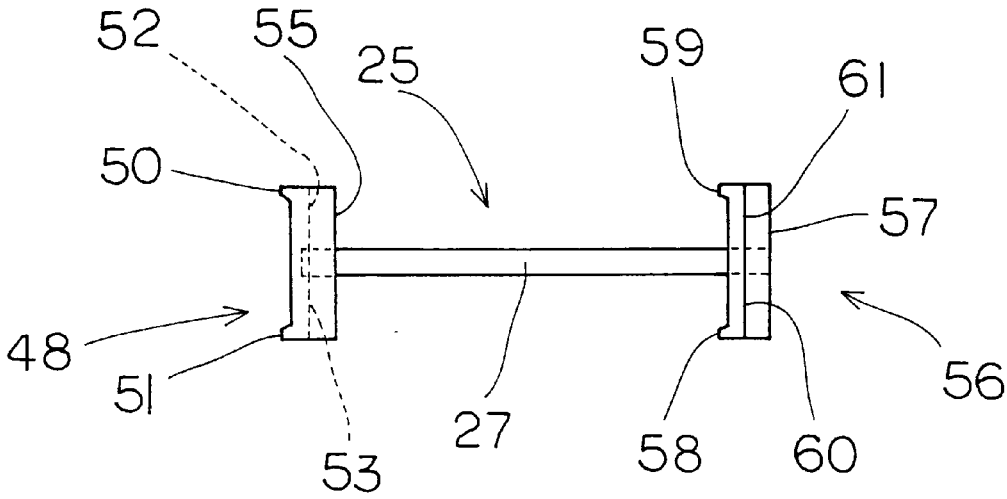
FIG. 7 shows a top view of a joint bracket.

The joint bracket 25 join the breast wall panels 15 which are adjacent horizontally and the top and bottom step breast wall panel rows 16–19 which are arranged backwards and forwards at the same time. As FIGS. 5–8 show, first joint bracket 25 forms a right-angled triangle from the side view. The length of the front vertical part 26 is almost the same as the vertical distance between joints 34 and 37 placed on the top of both sides of the breast wall panel 15 and the joints 35 and 38 placed on the middle. Joint parts 48,49 are formed on each of the top and bottom of the front vertical area 26. Joint parts 48,49 are fitted into the hook-shaped wedged part inserting spaces 44,45 formed on the corresponding joints 34, 35, 37 and 38 of the joining breast wall panel 15. As FIGS. 5–7 show, joint parts 48,49 are joined to the front vertical area 26 at a right angle from the plane level view and constructed by the pair of hook-shaped locks 52,53 which have catches 50,51 on the end and the falling prevention lid 55 which is connected to the upper end as one. Furthermore, joint parts 48,49 are preferred to be the wedge-shaped parts which are tapering shapes and narrowed downwards. First joint bracket 25 may also be made of cast iron.

As FIGS. 5–8 show, on the back of the upper horizontal area 27 of the first joint bracket 25, the joint parts 56 are set as one which are fitted into the hook-shaped wedged part inserting spaces 44 and 45 which are formed on the joints 36 and 39 placed on the bottom of both sides of the adjacent breast wall panel 15. As FIGS. 5–7 show, the joint parts 56 are joined to the upper vertical area 27 at right angle from the plane level view with the falling prevention lid 57 in between, and constructed by the pair of hook-shaped locks 60,61 which have the catches 58,59 on the end. Here, the joint parts 56 are preferred to be the wedge-shaped pairs which are tapering shapes and narrowed downwards.

Joint parts 48,49 on the front vertical area 26 of the first joint bracket 25 are fitted into the corresponding joints 34, 35, 37 and 38 on the adjacent bottom step breast wall panel 15 and the corresponding joints 56 on the back of the upper horizontal area 27 of the first joint bracket 25 are fitted into the corresponding joints 36, 39 which are placed on the adjacent breast wall panel 15 which constructs the top step, to join the breast wall panels 15 together which are adjacent horizontally and to join the top and bottom step breast wall panel rows 16–19 which are arranged backwards and forwards can be performed at the same time.

Figure 8:
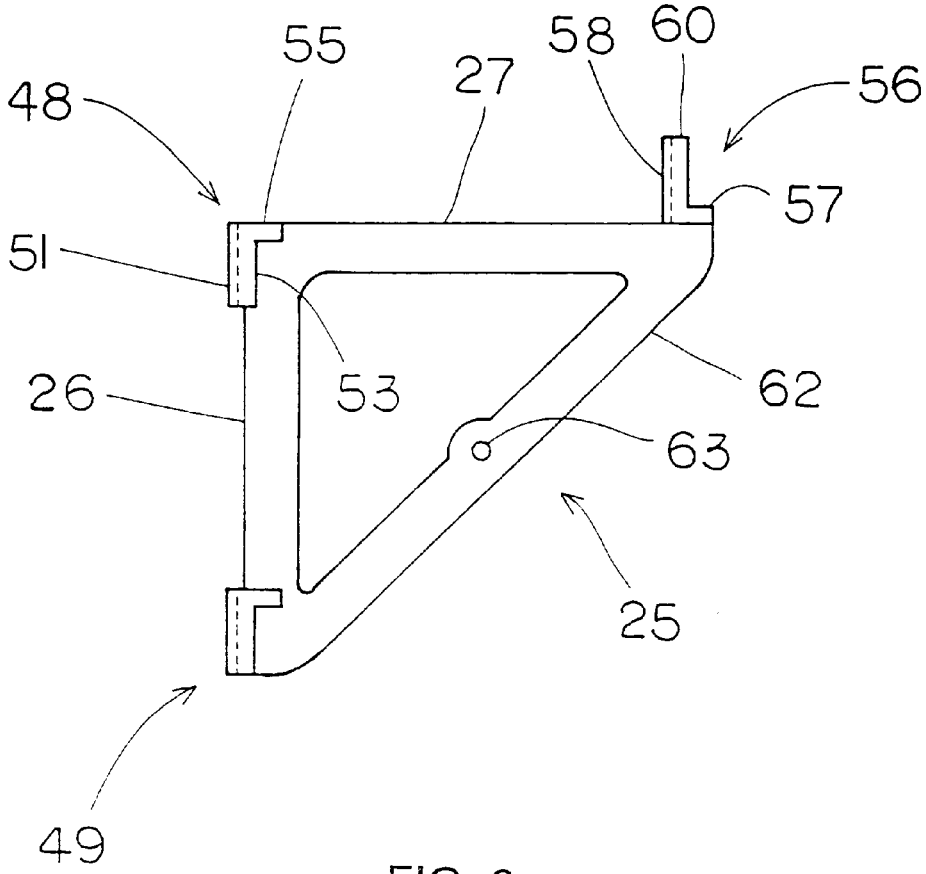
FIG. 8 shows a side view of the joint bracket of FIG. 7.

As FIG. 5 and 8 show, for the first joint bracket 25, the gap hole 63 is placed in the middle of the slope side 62 which join the bottom end of the front vertical area 26 and the bottom of the upper horizontal area 27. And, as FIGS. 1–2 show, by putting pivotal pin 64 through the gap hole 63, the top parts of the breast wall support stays 28,29 are joined to the first joint bracket 25 to support the base end against the soil slope 12.

As shown, each breast wall panel 15 of each breast wall panel row 16–19 can be supported certainly and safely from the back, the surface terrace 20 formed by the many steps of breast wall panel rows 16–19 can be formed easily and safely, even height breast wall can be constructed easily, quickly and safely.

Figure 9:
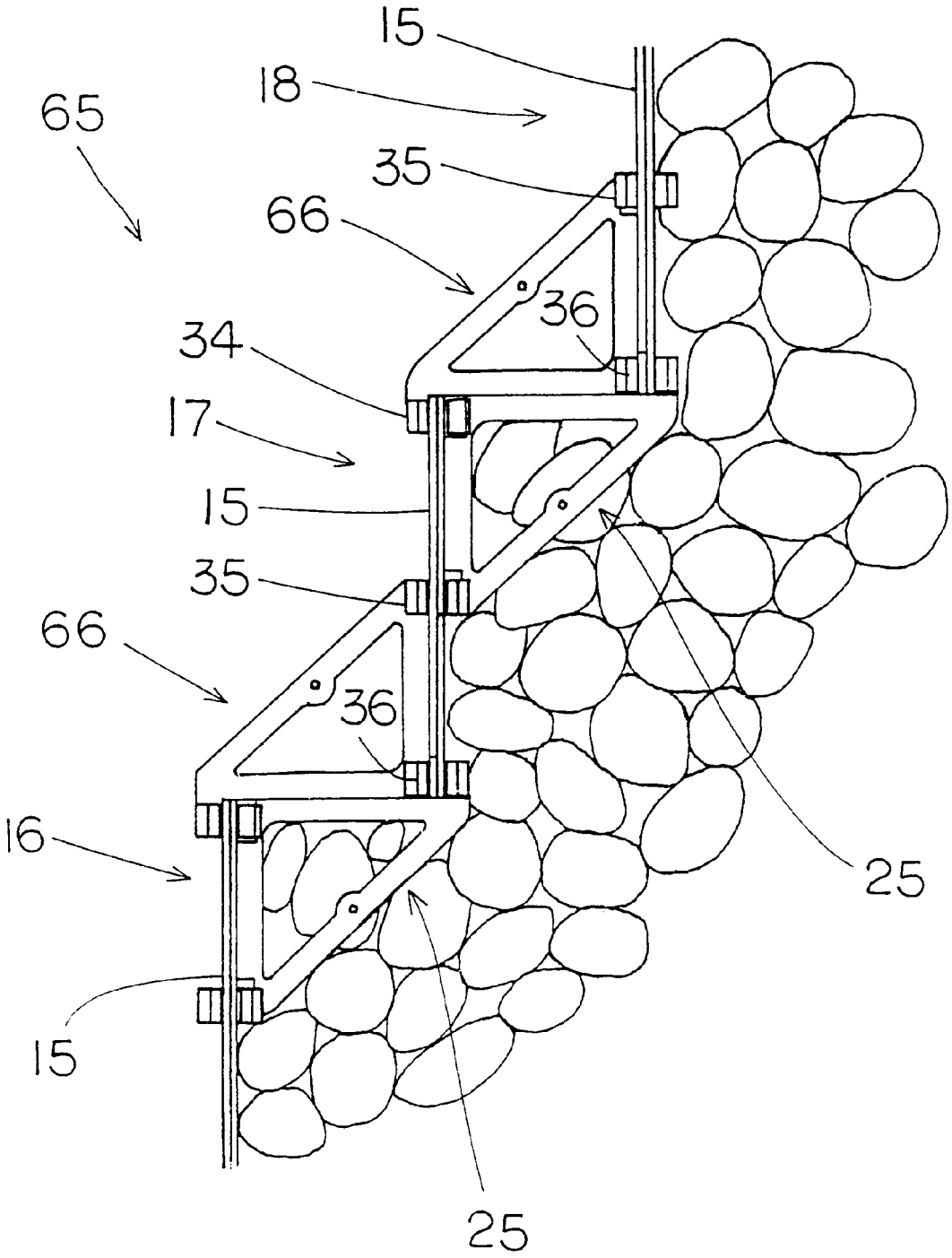
FIG. 9 shows a side cross section of an alternate breast wall construction utilizing two joint brackets at each joint.
Figure 10:
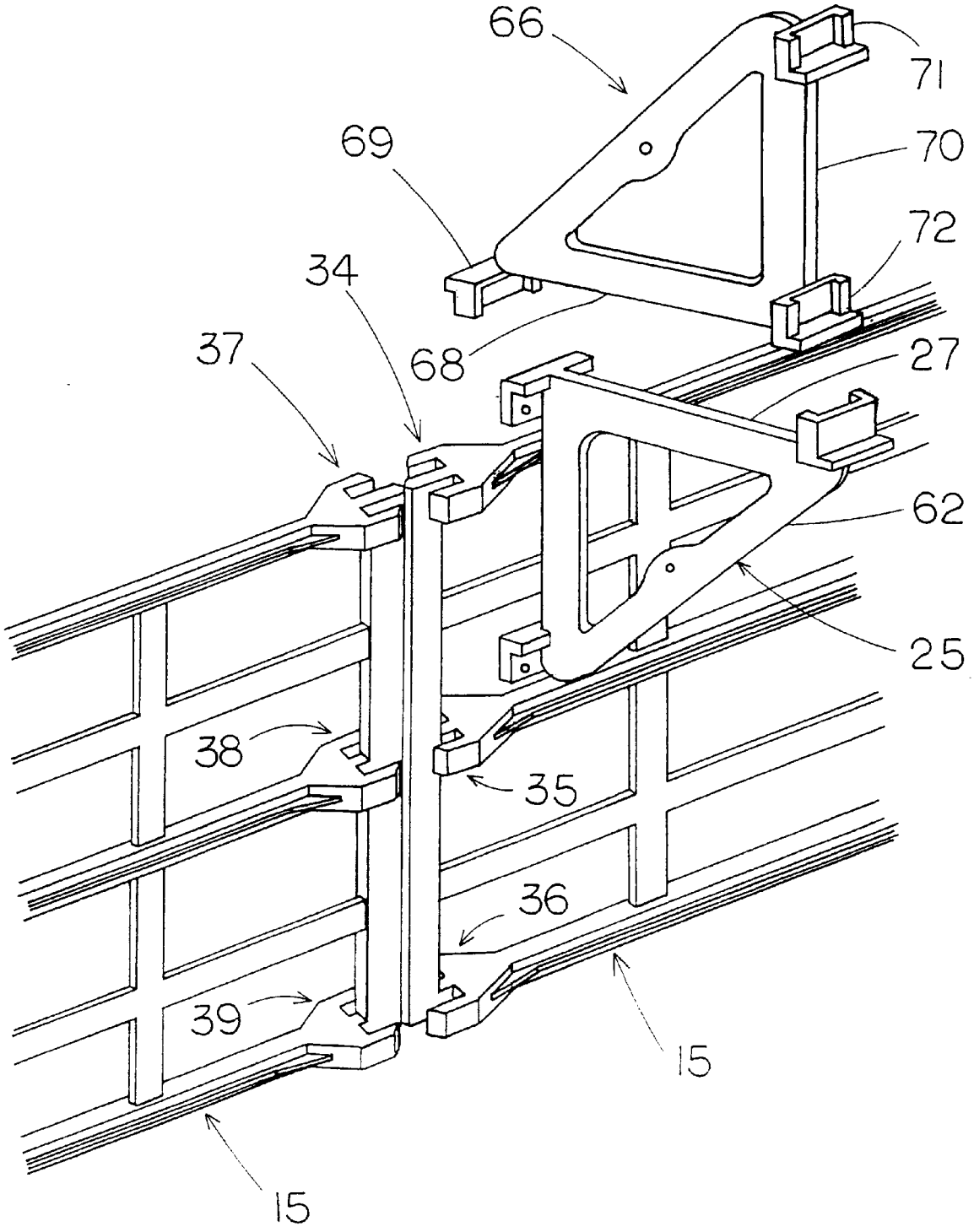
FIG. 10 shows a perspective, partially exploded, view of a joint of the embodiment of FIG. 9.

FIGS. 9–10 show an alternative embodiment breast wall construction 65. In this embodiment, the top step breast wall panel 15 is joined to the bottom step breast wall panel 15, by both first joint brackets 25 and second joint brackets 66. The second joint brackets 66 are preferably of the same construction as the first joint brackets 25 and are made of cast iron. By placing the first and second joint brackets 25,66 like a diamond shape, the joint between the top and bottom step breast wall panels 15 is strengthened. To construct the breast wall construction 65, joint parts 69 on the front of the bottom horizontal area 68 of the second brackets 66 are fitted into the corresponding joints 34,37 on the top of the adjacent bottom step breast wall panel 15, while joint parts 71, 72 on the top and bottom parts of the back vertical area 70 of the second joint brackets 66 are fitted into the corresponding joints 36, 37, 38 and 39 on the front of the adjacent top step breast wall panel 15. Joint parts 69, 71 and 72 on second joint bracket 66 substantially have the same construction as joint parts 56, 48 and 49 on the first joint bracket 25.

Figure 11:
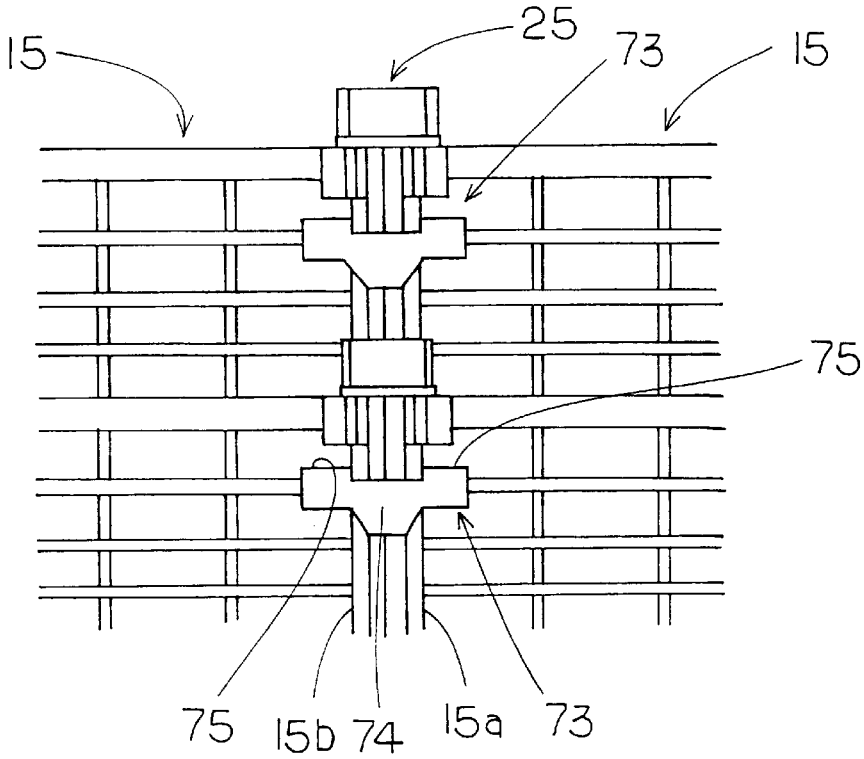
FIG. 11 shows a partial front view of a beast wall with anti-shaking mechanisms attached thereto.
Figure 12:
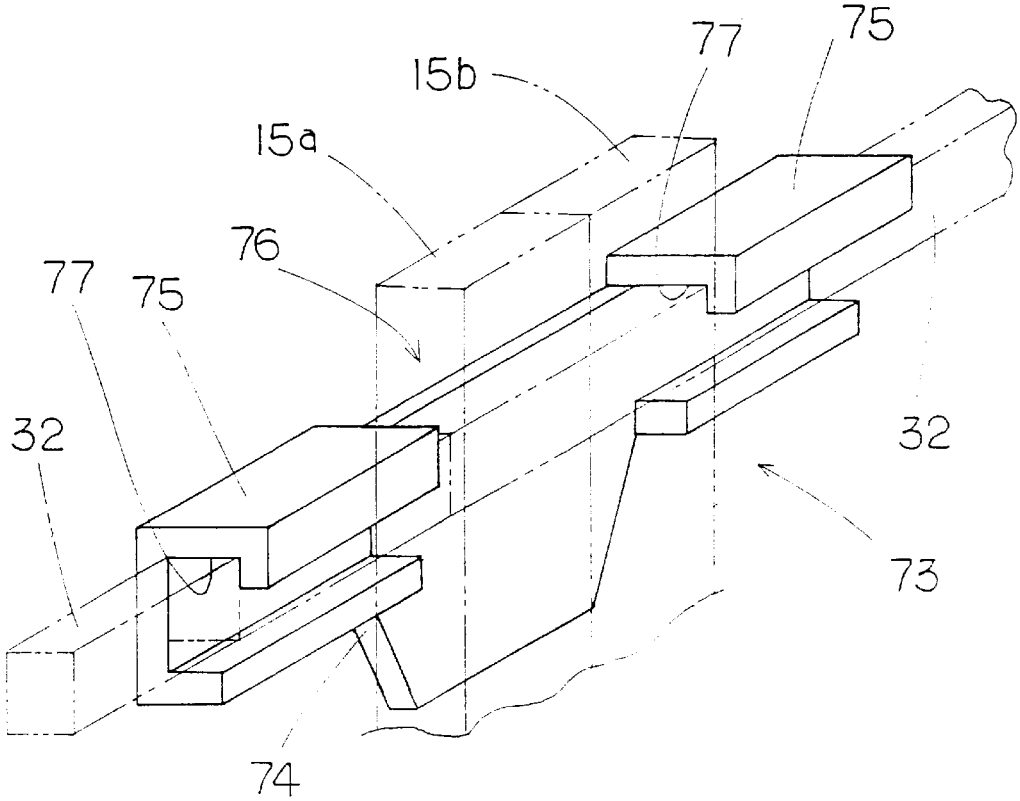
FIG. 12 shows a partial perspective view from the rear of the anti-shaking mechanism/breast wall panel connection of FIG. 11.

FIGS. 11–12 show an anti-shaking mechanism 73 used to prevent shaking back and forth between breast wall panels 15 forming each breast wall panel row 16–19. The anti-shaking mechanism 73 includes a material connecting channels 75 joined by horizontal long connecting board 74. Each material connecting channel 75 includes a connecting grove 77 adapted to accept the top part of the horizontal cross piece 32 thereinto. Between the material connecting channels is space 76 formed by cutting the middle part of the material connecting channel 75 in the almost same width of both sides 15*a* and 15*b* of the both breast wall panels 15 which are trying to connect horizontally. After setting both sides passing space 76 of the anti-shaking mechanism 73 to the both sides 15*a* and 15*b* of the both breast wall panels 15, and fitting the material connecting channels 75 to the respective horizontal cross pieces 32 on both breast wall panels 15, the back of the connecting board 74 is pushed against both breast wall panels 15 and then pulled downwards. This action fits the horizontal cross piece 32 to the connecting grove 77, thereby preventing the back and forth movement between the breast panels 15.

To construct a shore protection wall 11 as shown in FIGS. 1, 2 and 5, the first step breast wall panel row 16 is formed by horizontally joining many breast wall panels 15. On the back of this breast wall panel row 16, many truss construction first joint brackets 25 are placed, and these front vertical areas 26 are joined to the top of the breast wall panel row 16. Second, by joining the bottom of the second step breast wall panel row 17 to the back of the upper horizontal area 27 of the first joint brackets 25, the first step and the second step of the breast wall panel row 16 and 17 are joined. By joining the breast wall panel rows similarly from the second step to the fourth step in order, the surface terrace like steps 20 are formed along with the soil slope 12. After that, the stone filling spaces 21 formed between the soil slope 12 and the surface terrace 20 is filled with stones 22, the shore protection wall 11 is constructed.

By using the first joint brackets 25 with truss construction after forming the surface terrace 20 in advance, filling stones 22 into the heating stone filling space 21 formed between the soil slope 12 and the surface terrace 20, the shore protection wall 11 can be constructed. Therefore, the shore protection wall 11 can be constructed easily, quickly and safely without using a heavy machinery. In this situation, the surface terrace 20 can be formed by only fitting the joint parts 48,49 and 56 of the first joint brackets 25 into the joints 34–39 of the breast wall panel 15. Therefore, the surface terrace 20 can be easily formed. From this side, the shore protection wall 11 can be constructed easily, quickly and safely.

As FIGS. 9–10 show, because the breast wall panels 15 can be joined by using not only the first joint brackets 25 but the second joint brackets 66, the stronger shore protection wall 11 can be constructed.

Furthermore, by voluntarily deciding the number of steps of the breast wall panel row which construct the surface terrace 20, the shore protection wall 11 with many steps can be easily constructed. In this situation, by using the breast wall support stays 28 and 29, the stability of the shore protection wall 11 with many steps can be improved.

The above, this invention is explained referring to illustrative examples. This invention is not limited to these illustrative examples, and different types of changes can be implemented without deviating from the scope of the invention. In this connection, nothing is explained on the above about the bottom part and the lid part of the hollow framing constructed by joining many breast wall panels but, of course, the bottom part with many openings, each or both lid parts can be set and used as the breast wall panels which form the side wall. And said bottom part and lid part made of cast iron are used as the breast wall panel.

As it is clear by the above explanations, a breast wall construction may be made by forming the surface terrace by many breast wall panel rows which are constructed by joining each of many breast wall panels horizontally using the first joint brackets with truss construction, filling stones into the stone filling spaces which are formed between said soil slope and said surface terrace and constructing the shore protection wall. Therefore, the breast wall construction can be constructed easily, quickly and safely without using heavy machinery at any execution sites. In addition, by forming the breast wall panel with cast iron with many openings, the strength of the breast wall construction can be very much improved. When it is filled with stones, or when it is pressured by the soil from the back, the deforming of the surface terrace can be prevented, and the collapse of the breast wall can be effectively prevented. When the breast wall is the shore protection wall, from the under water part of the breast wall panel, the part of microscopic elements of carbon and the like leach out, promoting bacteria to attach and alga to propagate, and with that, the most appropriate environment for habitat of many types of organism including plants and fish. Furthermore, when the breast wall panel is made of cast iron with high quantity of carbon, it has enough corrosion resistance on the ground and even under the water and can be used for a long time. Moreover because the breast wall panel is made of cast iron, the same shape type of breast wall panel can be mass-produced by one cast type, and the unit price of breast wall panel can be decreased.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A retaining wall assembly, comprising:

a) a plurality of generally planar breast wall panels arranged into at least a lower row and an upper row on a slope, said upper row vertically staggered with respect to said lower row;

b) a plurality of first joint brackets spaced from one another and disposed generally normal to said lower row, said first joint brackets having a front vertical area and a back upper horizontal area and truss construction; and c) said front vertical area of said first joint brackets joined to the back of said lower row of breast wall panels and said back upper horizontal area of said first joint brackets joined to the bottom of said upper row of breast wall panels so as to join the back of said lower row of breast wall panels to the back of said upper row of breast wall panels so as to prevent horizontal displacement of said upper row relative to said lower row.

2. The retaining wall assembly of claim 1 further including:

a) a plurality of second joint brackets disposed generally normal to said lower row in a spaced apart fashion and having a front bottom horizontal area and a back vertical area and truss construction; and b) said front horizontal area of said second joint brackets joined to the front of said lower row of breast wall panels and said back vertical horizontal area of said second joint brackets joined to the front of said upper row of breast wall panels so as to join the front of said lower row of breast wall panels to the front of said upper row of breast wall panels.

3. The retaining wall assembly of claim 2 wherein said second joint brackets are substantially identical to said first joint brackets.

4. The retaining wall assembly of claim 1 further including a plurality of support stays anchored to the slope and attached to said first joint brackets.

5. The retaining wall assembly of claim 1 wherein said breast wall panels include integrally formed joint sections and wherein attaching said first joint bracket to said first row of breast wall panels also joins the corresponding breast wall panels together via said joint sections.

6. The retaining wall assembly of claim 5 wherein said joint sections include a pointed central tine, first and second outer tines extending parallel to said central tine and equally disposed on opposite sides thereof, and an embossment on said central tine opposite each of said outer tines, each of said outer tines forming a hook shaped cavity with said central tine and the corresponding embossment.

7. The retaining wall assembly of claim 1 wherein said breast wall panels and are made from cast iron.

8. The retaining wall assembly of claim 1 wherein said breast wall panels and said first joint brackets are made from cast iron.

9. The retaining wall assembly of claim 2 wherein said breast wall panels, said first joint brackets, and said second joint brackets are made from cast iron.

10. The retaining wall assembly of claim 1 wherein said breast wall panels include integrally formed joint sections and wherein attaching said first joint bracket to said first row of breast wall panels also joins the corresponding breast wall panels together via said joint sections, and said breast wall panels and said first joint brackets are made from cast iron.

11. The retaining wall assembly of claim 1 wherein:

a) said breast wall panels include integrally formed joint sections b) said first joint brackets include integrally formed joint sections;

c) and wherein attaching said first joint bracket to said first row of breast wall panels also joins the corresponding breast wall panels together via said joint sections, and d) said breast wall panels and said first joint brackets are made from cast iron.

12. The retaining wall assembly of claim 2 wherein:

a) said breast wall panels include integrally formed joint sections b) said first and second joint brackets include integrally formed joint sections;

c) and wherein attaching said first joint bracket to said first row of breast wall panels also joins the corresponding breast wall panels together via said joint sections, and d) said breast wall panels and said first and second joint brackets are made from cast iron.

13. The retaining wall assembly of claim 5 wherein said joint sections are wedge shaped.

14. The retaining wall assembly of claim 11 wherein said joint sections of said first joint brackets are wedge-shaped.

15. The retaining wall assembly of claim 12 wherein said joint sections of said first and second joint brackets are wedge-shaped.

16. A retaining wall assembly, comprising:

a) a plurality of generally planar breast wall panels arranged into at least a lower row and an upper row on a slope, said upper row vertically staggered with respect to said lower row;

b) a plurality of first joint brackets disposed generally normal to said lower row in a spaced apart fashion with respect to each other; said first joint brackets including joint means for mating with at least two of said breast wall panels and having truss construction; and c) wherein the back of said lower row of breast wall panels is joined to the back of said upper row of breast wall panels via said joint means of said first joint brackets so as to prevent horizontal displacement of said upper row relative to said lower row.

* * * * *